United States Patent [19]

Faith

[11] 4,427,199

[45] Jan. 24, 1984

[54] TARGET SCORING SYSTEM

[76] Inventor: Donald L. Faith, 1503 Park Rd., SE., Atlanta, Ga. 30315

[21] Appl. No.: 941,948

[22] Filed: Sep. 13, 1978

[51] Int. Cl.[3] ..... F41J 5/06

[52] U.S. Cl. ..... 273/371; 273/372; 434/19; 434/22

[58] Field of Search ..... 35/22 R, 25; 273/1 E, 273/101.1, 101.2, 102.1 R, 102.1 B, 102.1 C, 102.1 F, 102.2 R, 102.2 A, 102.2 B, 102.2 S, DIG. 28, 102.1 E, 371, 372; 124/32, 33, 34; 340/323 R; 434/11, 19–22

[56] References Cited

U.S. PATENT DOCUMENTS

| | | | |
|---|---|---|---|
| 2,709,592 | 5/1955 | McAvoy | 273/102.2 A |
| 3,022,076 | 2/1962 | Zito | 273/102.2 S |
| 3,233,904 | 2/1966 | Gillam et al. | 273/102.2 S |
| 3,624,401 | 11/1971 | Stoller | 273/102.2 B |
| 3,770,981 | 11/1973 | Nelsen | 124/32 X |
| 3,778,059 | 12/1973 | Rohrbaugh et al. | 273/102.2 S |
| 3,870,305 | 3/1975 | Harclerode | 273/101.1 |
| 3,914,879 | 10/1975 | Taylor et al. | 273/406 |
| 3,933,354 | 1/1976 | Goldfarb et al. | 273/1 E |
| 4,065,860 | 1/1978 | Linton et al. | 273/101.1 X |
| 4,129,299 | 12/1978 | Busch | 273/102.2 S |
| 4,192,507 | 3/1980 | Rains et al. | 273/311 |

FOREIGN PATENT DOCUMENTS

| | | | |
|---|---|---|---|
| 1953793 | 4/1971 | Fed. Rep. of Germany | 273/102.2 R |
| 2360094 | 6/1975 | Fed. Rep. of Germany | 273/102.2 B |

*Primary Examiner*—Vance Y. Hum

*Attorney, Agent, or Firm*—Cushman, Darby & Cushman

[57] ABSTRACT

A system for scoring targets with a control module and plurality of timer modules connected thereto. The control module generates start and stop signals and the timer modules count the number of hits on one or more targets and the time required to make an adjustable number of hits. Each hit is detected by an electrooptic sensor. The start signal can be generated by a sound, by a pseudo-random generator or by manual switch operation.

23 Claims, 9 Drawing Figures

To Fig. 3b
216
696
600
602
604
606
608
614
616
618
627
640
642
650
652
654
656
658
660
662
664
666
668
673
674
680
682
684
686
200
208
210
a
b
c
d
e
f
g
50HZG
MRST
JSTSEL
MST
SEQST
MSTP
DSA
DSH
MBLNK
AISTP
100HZ
1HZ
VCC
GND

FROM Fig. 3a
214
DRIVER
630
610
626
620
624
625
670
628
630
633
220
START
STOP
671
672
DSA
ON
692
693
632
212
a
b
c
d
e
f
g
50HZG
MRST
SSTEL
MST
SEQSTP
MSTP
DSA
DSH
MBLNK
ALSTP
100HZ
1HZ
VCC
GND.

TARGET SCORING SYSTEM

DESCRIPTION OF THE BACKGROUND AND SUMMARY OF THE INVENTION

The present invention relates to a system for scoring targets hit by a marksman during practice.

It is disturbing that many people are forced to choose between the loss of life or limb, and the use of a firearm. Still worse, most of these people are not trained, either in the decision making, or in the proper use of such a firearm.

The training courses currently in use by military, police and civilians are almost all based upon shooting a fixed target under ideal conditions. Even the so-called Practical Police Course, and special police combat courses are in reality only target courses which use a silhouette rather than the familiar bullseye. These courses are incapable of adequately training an individual in the practical defensive use of a firearm.

Techniques are now used by target shooters to develop and maintain basic firearm skills without the necessity of frequent trips to the range and firing large quantities of ammunition. These techniques, however, are today of little value to the person who seeks to become skilled in the defensive use of a firearm. Dry firing, while lone used by target shooters to become initimately familiar with a particular firearm and to develop and maintain breathing, sight alignment, sight picture, grip, trigger pull, etc., is of little use to someone who must develop a high degree of expertise in the practical and defensive use of a firearm. In the real world, true expertise demands the balance of many factors not required in target shooting, such as speed, reaction time, judgement, recognition and accuracy. Often, poor light, short time and awkward position preclude the use of sights and demand instinctive or point shooting.

Due to expense, attempts to simulate real world situations using motion pictures and various electronic guns and shooting gallery configurations have not been successful. The feel and construction of electronic guns are quite different from those of a real loaded firearm, and a high degree of skill with a training firearm is of no value when a real situation is encountered and the officer must use a real firearm. Second, because of the bulk of such systems, they are limited to two or three variations of the same scheme.

The present invention relates to a unique system which provides the flexibility of realistically simulating many different situations for both sport and practice shooting. These include drawing and shooting, movement through a course, encountering different light and terrain conditions, sequential firing at different targets, distinguishing between targets and "hostages," etc. Hits are accurately counted and timed during different shooting routines. The present invention further has the flexibility of being readily adaptable to existing target ranges and contests.

This is accomplished in the present invention by providing a separate control module and a plurality of timer modules connected thereto. The control module produces a start signal and, at a given time thereafter, a stop signal. Hits can be counted only in the time between the start and stop signals. The timer modules are each connected to one or more sensors, and count the hit signals which are made between the start and stop signals and the time between the start signal and the time at which a predetermined number of hit signals have been counted. The number of hits and the times are then displayed. By using separate modules, maximum flexibility is provided, and one control module can be used to control as many separate timing modules as desired.

A number of different aspects of the present invention provide its flexibility. According to one aspect of the invention, a separate hostage or disqualify target provides a signal to the timing module which, if hit, displays dramatically, for example, by flashing the display, that an incorrect target has been struck.

Within the control module, start logic is provided which permits the system to begin operation upon receipt of any of a plurality of different inputs which can be selected. The system can respond to a sound, for example, a starting gun, whistle or gong. An enable circuit, connected to the sound-start circuit is operable by a switch so that the sound must be produced within a predetermined time after switch operation, thus protecting against inadvertent starting. Alternately, a manual switch can be used to initiate operation of the system. By a third choice, a pseudo-random start circuit can be used to produce a start signal at a given time after operation of the manual switch or after all of the timer modules have produced and ALLSTOP signal, indicating completion of their cycle.

According to a further aspect of the invention, each of the timer modules includes two counter circuits which can be set to record different counts. Upon reaching its predetermined count, the first counter produces a signal which transfers to a latch the count of the hit counter in the display and the time counter in the display. When the second counter reaches its predetermined count, a logic signal produces an ALLSTOP signal which prevents further counting in the time counter. Logic circuitry within the control module permits either the contents of the latch or the contents of the display counter to be displayed.

According to a further aspect of the invention, the control module can operate in a sequential start mode in which only one timer module is started by the control module and the next timer module is started by the end of the cycle of the first timer, etc.

Other objects and purposes of the invention will be clear from the following detailed description of the drawings.

DETAILED DESCRIPTION OF THE DRAWINGS

Figure 1:
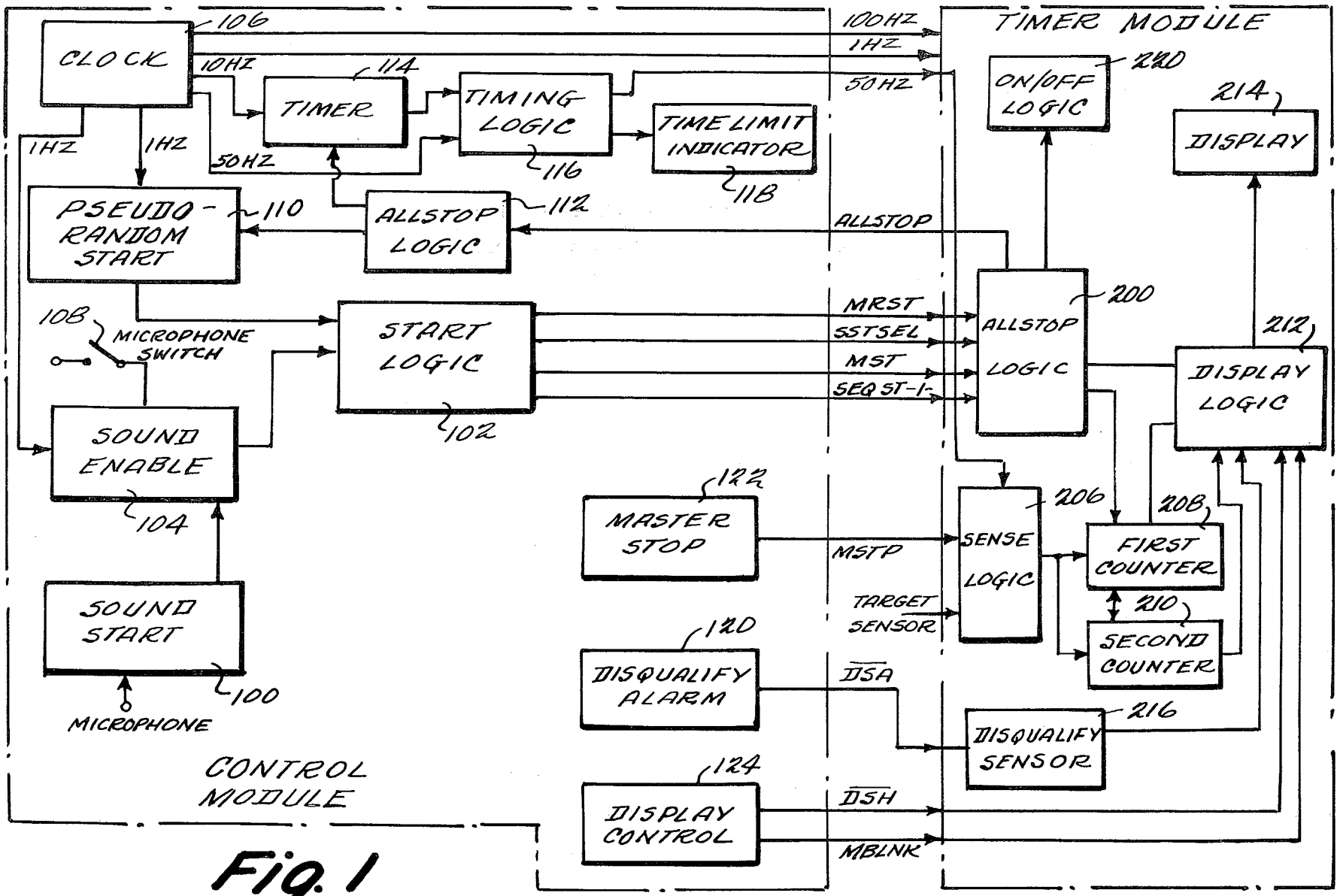
FIG. 1 is a block diagram of the system of the present invention.

Reference is now made to FIG. 1 which shows a block diagram of the control module and one timer module. It will be understood that the system will normally be used with a number of timer modules as desired in any given situation. Each of the marksmen using the system may be assigned one timer module or two or more timer modules may be connected together for sequential use by one marksman going through a routine.

As described generally above, the system can be started in at least one of three different ways. First, the reset signal MRST must be produced by logic 102, either in response to operation of a reset switch or automatically if the system is cycling automatically. Then the system can be started. One way to start is by a sound which causes the circuit 100 to produce a sound start signal and apply that signal to start logic 102. Sound enable circuit 104 is connected to the 1 Hz output of conventional clock 106 and is operated by a microphone switch 108. After switch 108 is manually operated, sound enable circuit 104 enables the sound start circuit 100 for a predetermined time, for example, sixteen seconds. The use of the sound-enable circuit protects the system against inadvertent false starts or restarts by loud noises. Start logic 102 then produces a master start signal MST which is applied to the allstop logic 200 in each of the timer modules.

Pseudo-random start circuit 110 can be alternatively used to cause the system to automatically cycle after all of the timer modules have produced the allstop signal indicating proper completion of their cycle. Logic circuitry 110 receives the allstop signal via logic 112 and provides an output to start logic 102 at a variable time thereafter, thus providing a pseudo-random variation of the start signal.

Third, a manually operated switch can be used to provide the start signal.

Clock 106 is connected to a timer 114 which is enabled by allstop logic circuit 112 to count pulses from the clock 106 and to provide a stop signal to the timing logic 116 upon a predetermined count, thus indicating the period in which hit signals can be counted by the timer module. A time limit indicator 118 sounds a signal, for example, a gong, when time expires. Timing logic 116 gates a 50 Hz signal from clock 112 to each of the timer modules between the start and the stop signals. The 50 Hz signal is applied to the sensor logic 206 in the timer module so that sensor logic 206 can apply hit signals to counters 208 and 210 only as long as the 50 Hz signal continues. Counters 208 and 210 are connected to the display logic 212 which in turn drives the conventional display 214. Use of two counters enables one of the counters to be set for a first number and the other to be set for a second number of hit signals. When the first counter accumulates a count equal to its preset number, a signal is applied to the display logic to cause the number of hits and the time to be stored in an internal latch.

A disqualify sensor 216 is connected to a sensor associated with a target which is not to be hit, for example, representing a hostage. If such a target is hit, disqualify sensor 216 applies a signal to display logic 212 which causes the display to flash. In addition an alarm 120 is activated within the control module.

Master stop 122 in the control module produces a signal MSTP which is applied to the allstop logic 200 to cause the allstop signal to be produced and the cycles in each of the timers to end. ON/OFF logic 220 is used to produce a signal when a timer finishes its cycle. This signal can be used to change light conditions, cause target movement, etc., and is particularly useful in sequential operation to change the conditions for shooting to be scored by another timer module. Display control 124 in the control module is connected to the display logic for controlling which of the stored signals of hits and accumulated time is displayed.

Figure 2A:
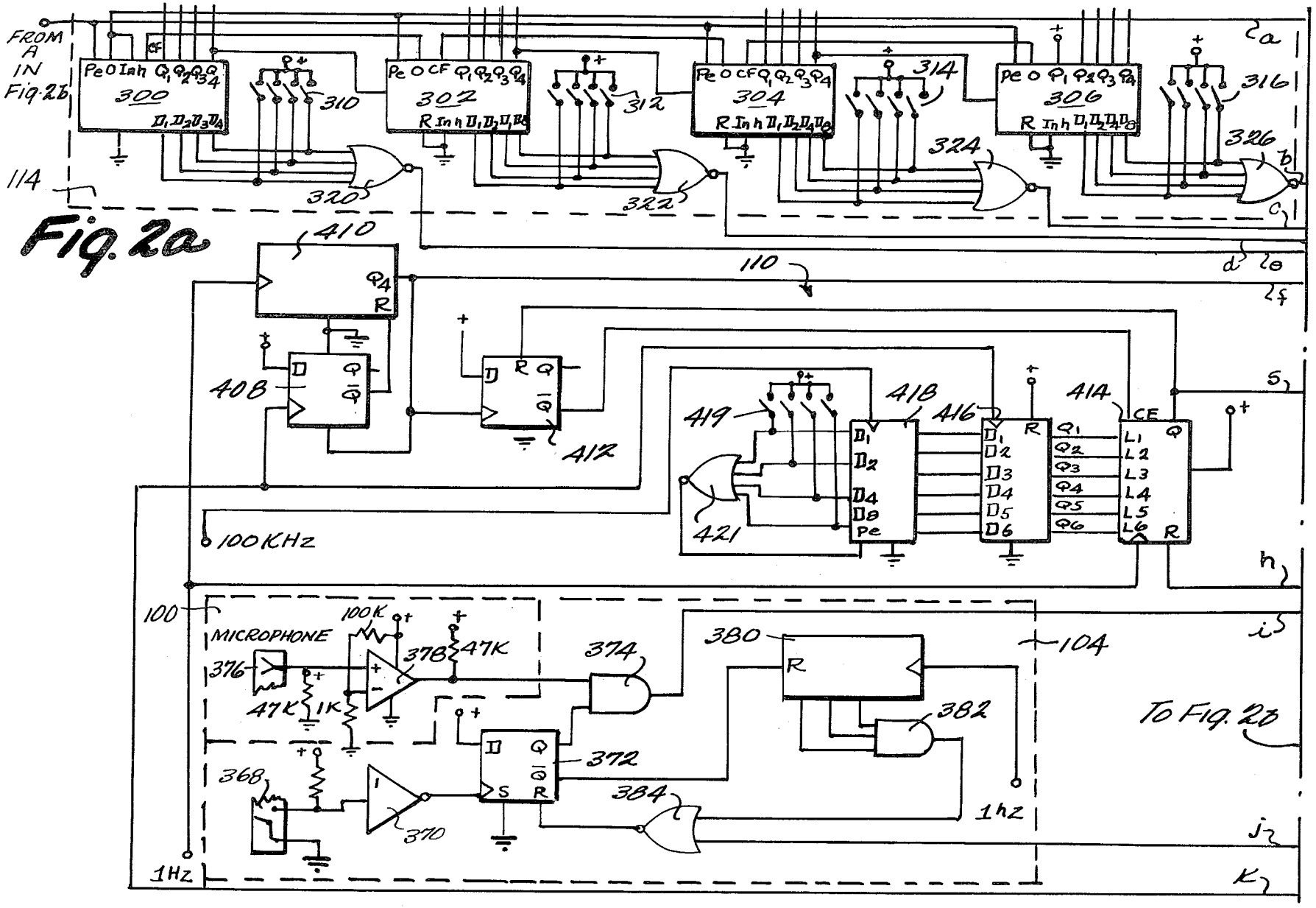
FIGS. 2*a* and 2*b* are a detailed schematic of a control module.
Figure 2B:
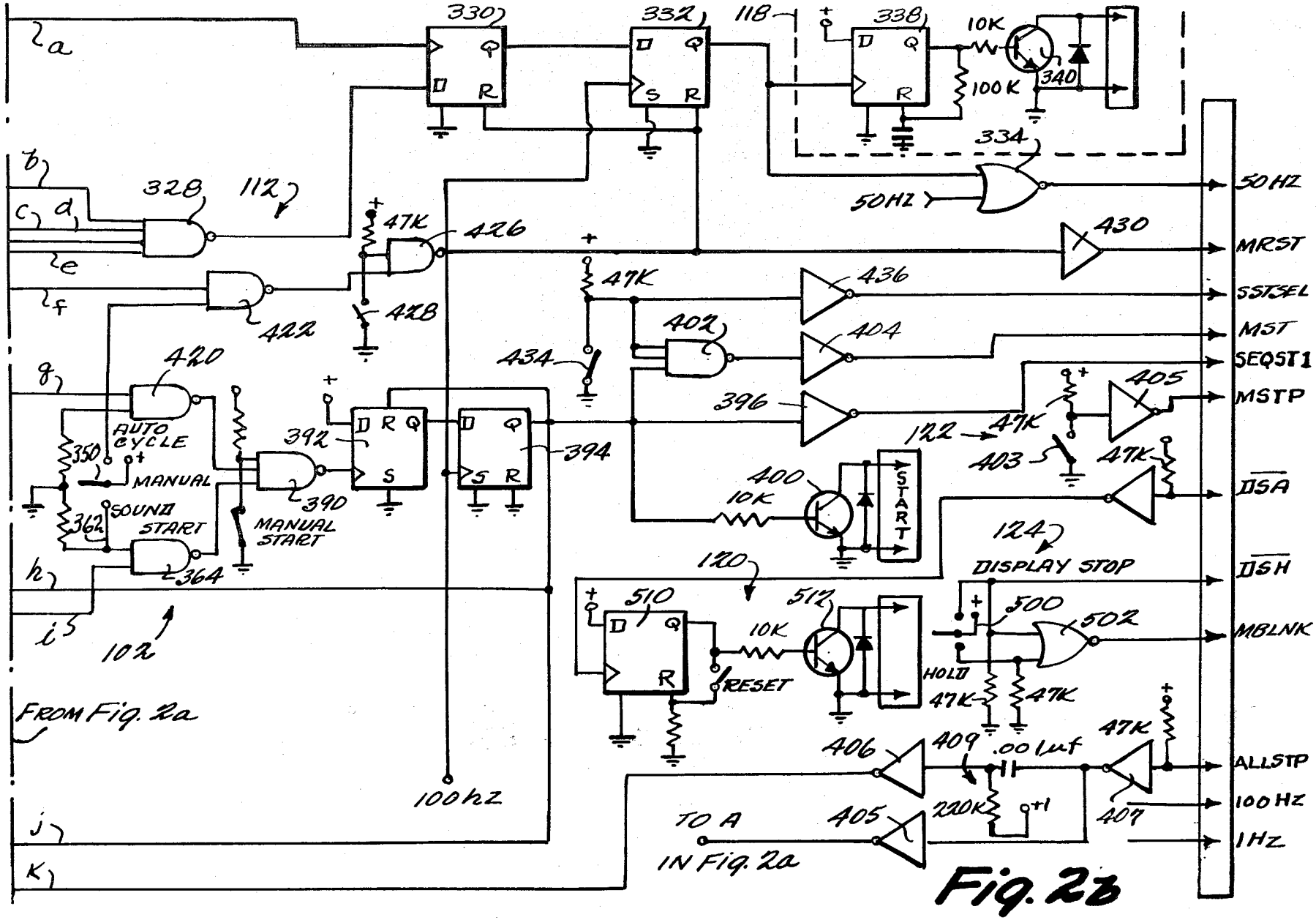

Reference is now made to FIGS. 2 and 3, which respectively show in detail one embodiment of the control module and one embodiment of a timer module. It will, of course, be understood that an operative system will include a control module and at least one or more timer modules as desired to produce a realistic simulation of whatever number of marksmen are to fire at the same time.

Timer 114 includes a plurality of conventional counters 300, 302, 304, and 306, each having a plurality of pre-selectable thumbwheel switches 310, 312, 314, and 316 which can be manually adjusted to select any given output of the counters and thus any given time for the marksman to make his assigned number of hits and end a cycle. NOR gates 320, 322, 324, and 326 connect the outputs of counters 300, 302, 304 and 306 to NAND gate 328 of timer logic 116, which thus produces a low input to the data enable flip-flop 330 when the switches are all set to zero, so that no time limit is provided. When the switches are not set to zero and the assigned count is reached, the zero output of counter 300 goes high clocking flip-flop 330. Flip-flop 330 in turn enables flip-flop 332, which produces a signal in response to a pulse from the 100 Hz train disabling NOR gate 334 and thus preventing further 50 Hz clock signals from passing to the respective timer modules. As will be apparent from the discussion below, cessation of the 50 Hz waveform prevents the timer modules from counting further hit signals from the target sensors.

Flip-flop 338 in time limit indicator 112 is also triggered by the output of flip-flop 332 to shift the output of transistor 340 and to produce a signal which can be used to sound a gong or provide some other indication that the time for shooting has ended.

As described above, the timing modules are enabled to begin counting upon production of a start signal. This start signal can be produced in at least one of three ways. First of all, the start signal can be produced manually by closing switch 350. Second, the start signal can be produced by the pseudo-random start signal generator 110, which produces a start signal automatically following the completion of counting of all of the timer modules. Third, a start signal can be produced by the sound start circuit 100, if enabled by the sound enable circuit 104.

Assuming that it is desired to produce the start signal from a sound, switch 350 is shifted into connection with line 362 to apply a high signal as one input to NAND gate 364. Sound enable circuit 104 is connected to the other input to NAND gate 364. Upon closing of the microphone switch 368, invertor 370 applies a signal to flip-flop 372 to cause that flip-flop to apply a high enabling signal as one input to AND gate 374 which is part of sound enable circuit 104. The other input to gate 374 is from the microphone sound start circuit 100 so that when a sound of sufficient intensity is subsequently received at microphone 376, comparator 378 causes the output of gate 374 to become high causing the output of gate 364 to assume a low state.

The output of flip-flop 372 is also applied to counter 380 which is connected to the 1 Hz output of clock 106 so that counter 380 now begins counting. Upon a predetermined output indicating, for example, sixteen seconds, gate 382 assumes a high output which is applied to gate 384. OR gate 384 then resets flip-flop 372 so that the sound circuit 100 is enabled only until counter 380 reaches its predetermined count.

The output of NAND gate 364 is applied to NAND gate 390. The other inputs to NAND gate 390 are high so that the output of 390 now shifts to a high condition triggering flip-flop 392 which in turn triggers flip-flop 394. The output of flip-flop 394 is also applied to OR gate 384 to reset flip-flop 372.

The output of flip-flop 394 is applied as signal SEQST1 via inverter 396 and also to transistor 400 to operate any start signal device which is desired, for example, sounding a whistle, a bell, etc.

NAND gate 402 receives the output of flip-flop 394 which has now become high so that a high signal is produced at the output of inverter 404 as signal MST, the master start signal. Sequential switch 434 can be used to inhibit production of signal MST and instead produce signal SSTSEL as will be described below.

Referring now to FIG. 3 which shows the timer module in detail, the hit signals from each of the sensors connected to the timer modules are inverted by inverter 600 and applied to flip-flop 602 which shifts its output to cause flip-flop 604 to produce a hit signal. The 50 Hz train from the control module is required to enable flip-flop 604 so that when the 50 Hz train ends, when the time limit expires, no more hit signals can be counted. Using two flip-flops ensures only one hit will be recorded.

Each timer module includes first and second counters which are interconnected by the allstop logic 200 so that if both counters have a number other than zero manually selected, the time that the first counter reaches its count of hit signals is recorded in a latch and the second counter is activated. When the second counter reaches its assigned number, the ALLSTOP signal is received. The logic circuitry is designed so that either of the counters may be set alone or both may be set. If one of the counters is set at zero then the ALLSTOP signal is produced when the other counter reaches its assigned number. If both counters are set at zero, logic 112 blanks the display to minimize energy use and ensures that an ALLSTOP signal is produced continuously.

More particularly, down counter 606, if set to a number other than zero by manual switches 614 counts the hit signals received at the same time as counter 610. When the output of counter 606 matches the number set by switches 614, the zero output of counter 606 assumes a high state which is inverted by invertor 673 and applied to NOR gate 674. When the hit signal returns low, flip-flop 642 is set. Gate 640 is now enabled so down counter 608 can begin counting. Assuming for the moment that counter 608 has been set to record some number other than zero, then the other input to NOR gate 618 is low, and gate 618 has a high output enabling the data input to flip-flop 620 which in turn enables flip-flop 624. When the zero output of gate 606 assumes a high state, flip-flop 624 applies a high signal to NOR gate 625 which assumes a low output to cause the count in counter 626 to be entered into an internal latch. Since the output of gate 625 was previously high, the initial output of gate 670 into gate 625 is low but shifts then to high to produce a latching pulse.

Assume that the counter 608 is not to be used. The output of gate 650 will then, accordingly, be high and the shifting of the output of gate 616 will have no effect on gate 618.

If both counters 606 and 608 are set to zero, then both inputs to NAND gate 627 will be high producing a low output which is inverted by inverter 628 and applied to AND gate 630. This applies an input to OR gate 633 to blank the display. The output of gate 627 is also connected to flip-flops 654 and 684 to ensure that a timer module cannot respond to any start signal if both counters are set at zero.

If counter 606 is not set to zero, the low output of NOR gate 616 is applied as one input to NOR gate 640. The other input to NOR gate 640 is from flip-flop 642 which was reset by the output of the gate 664 to a low output. When counter 606 reaches its count, the zero output goes high so that when the trigger signal disappears, gate 674 sets flip-flop 642 which in turn causes gate 640 to assume a low output permitting counter 608 to count. The shift of gate 640 from high to low enables counter 608 to begin counting.

When counter 608 reaches its count, the zero output goes high shifting gate 656 to a low condition. The output of gate 658 now goes high. The other input to gate 658 is low since the high output on the zero output of counter 606 is inverted by inverter 673.

Flip-flop 654 in turn enables flip-flop 660 which responds to the 100 Hz clock pulses and causes the flip-flop comprising NOR gates 662 and 664 to shift its output from low to high thus disabling gate 632 and preventing further time counting. OR gate 666 responds either to a high output on flip-flop 660 or a MASTER STOP signal in order to produce the ALLSTOP signal of the timer module by shifting the output of transistor 668 high. Referring again to FIGS. *2a* and *2b*, the MASTER STOP signal is produced by operating switch 403 to apply a high signal to the master stop line via inverter 405.

The output of gate 664 is also connected to transistors 671 and 672 of the ON/OFF circuit 220. One transistor is conductive and the other non-conductive, while ALLSTOP is low and vice versa for controlling exterior devices such as lights. For example, the lights might be dimmed after six hits and the subsequent hits then counted on the second counter.

Production of the high ALLSTOP signal by each of the timer modules causes a high signal to be applied by inverters 405 and 407 to the preset input to each of the counters 300, 302, 304 and 306 of the control module, so that a new cycle can begin. In addition, capacitor and resistor 409 produce a negative edge trigger, which is inverted by inverter 406 to produce a high trigger signal which is applied to the clock input to flip-flop 408. The output of flip-flop 408 resets counter 410 which is connected to the 1 Hz output of clock 106. Counter 410 counts to a predetermined number, for example, 4, providing a delay of four seconds, and then resets flip-flop 408 and triggers flip-flop 412. The output of flip-flop 412 is connected to shift register 414 which now begins to shift in response to the 1 Hz pulse train. The output of inverter 406 is also applied to latch 416 which has connected as its inputs the output of counter 418 connected to the 100 kHz output so that counter 418 in effect provides a random input to latch 416. When the random count has been reached, gate 420 is enabled to in turn enable gate 390 and to provide the start signal in the same way as described above for the sound circuit, and flip-flop 412 is reset. The start signal also resets shift register 414. The output of counter 410 is also gated through NAND gate 422, when switch 360 is in the auto-start position. The output of gate 422 is applied to gate 426. A reset switch 428 is connected to the other input of gate 426 and either actuation of switch 428 or production of a signal by gate 422 is passed through gate 426 and inverted by inverter 430 to provide the master reset signal MRST. Switches 419 and gate 421 permit the delay to be programmed to any chosen value or the delay is random when the switches are all set at zero. Referring again to FIGS. 3*a* and 3*b*, the master reset signal MRST is applied to gate 670 to disable gate 625 and to reset inputs of counters 610 and 626 and flip-flop 672.

Figure 3A:
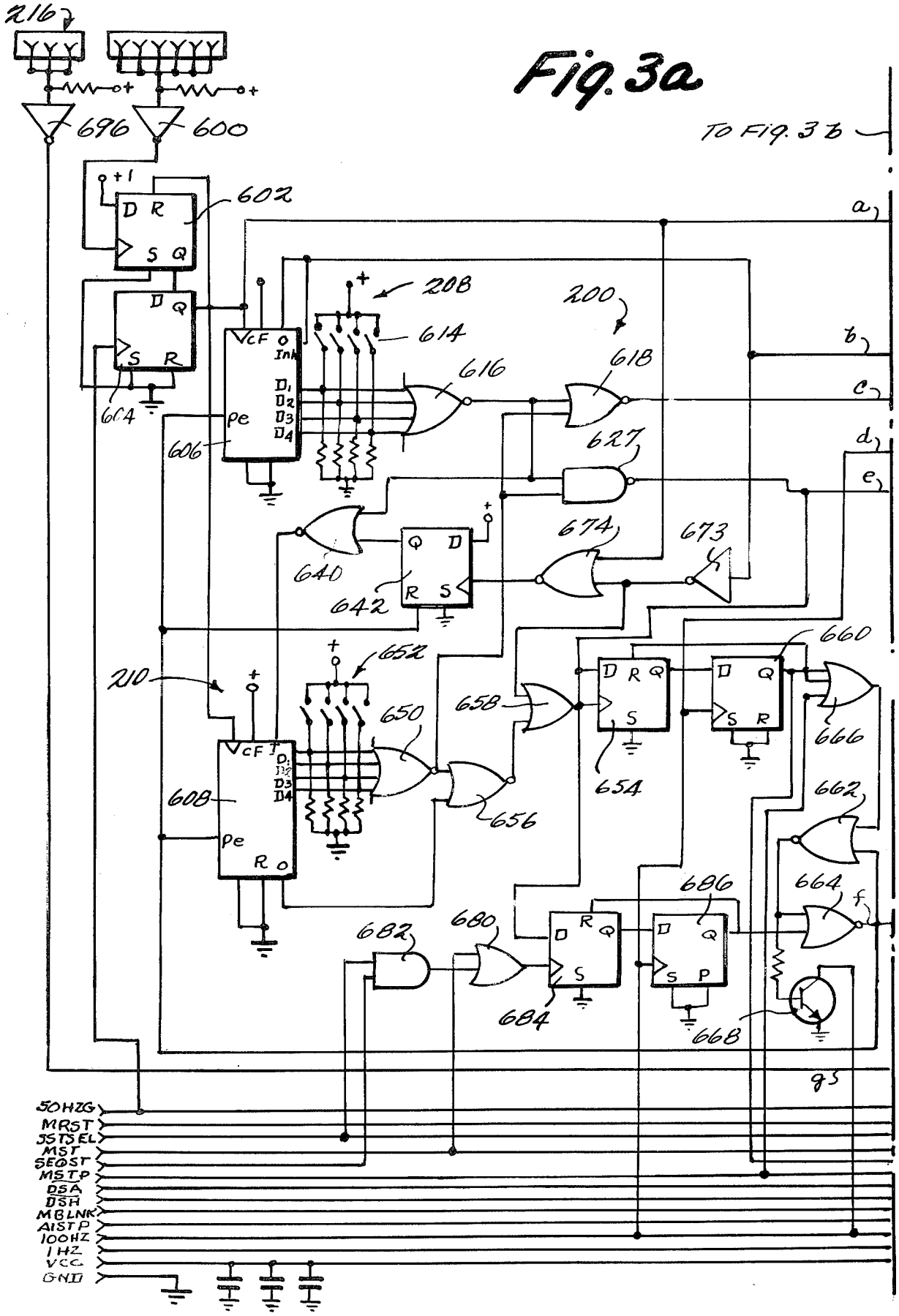
FIGS. 3*a* and 3*b* are a detailed schematic of a timer module.
Figure 3B:
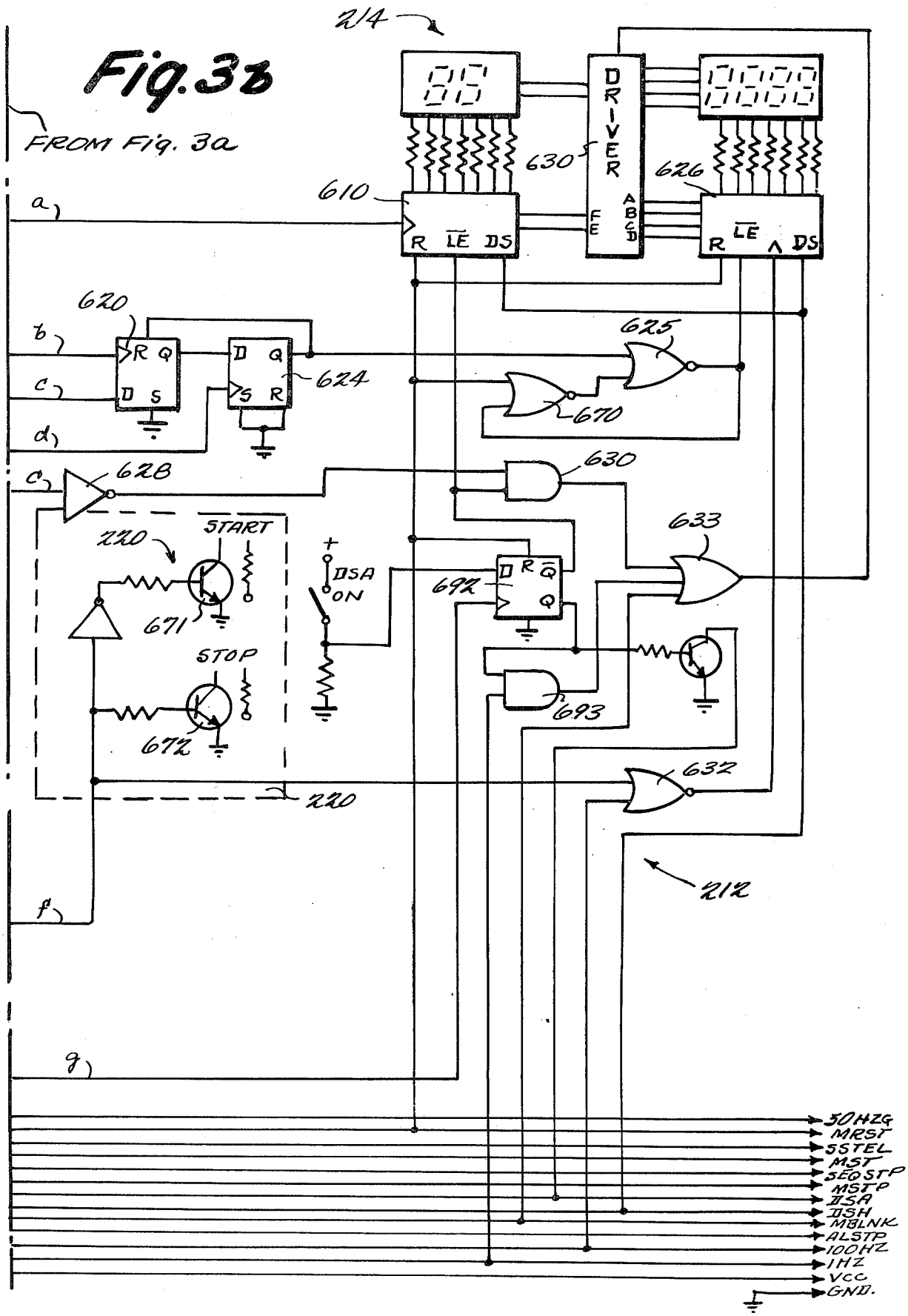
Figure 7:
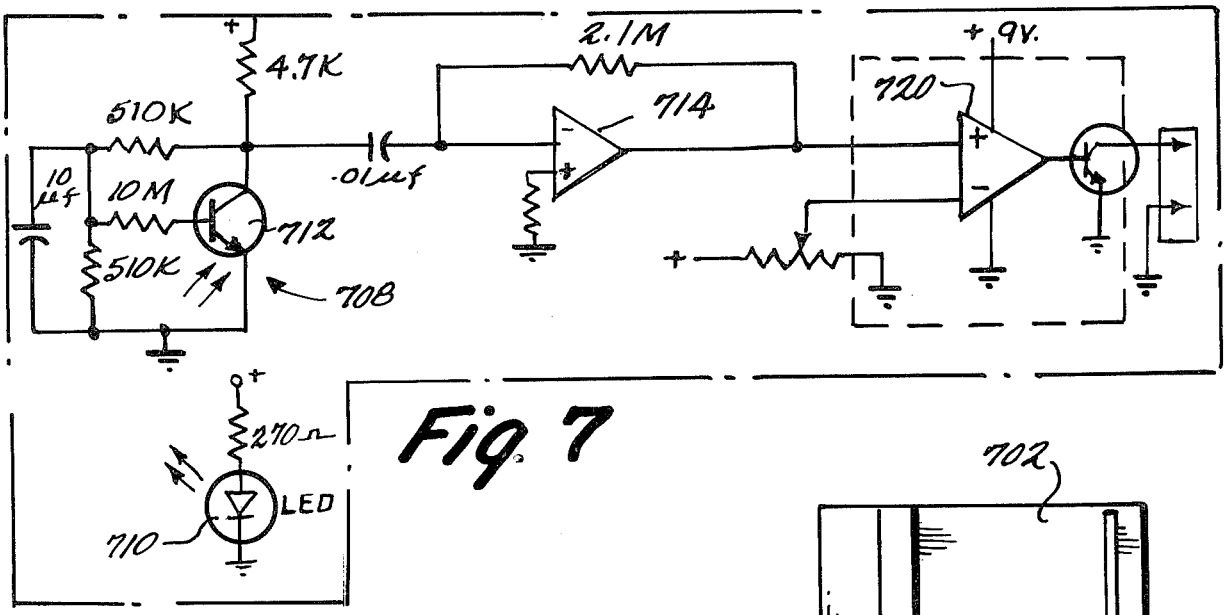
FIG. 7 is a schematic of the sensor circuit.

As described generally above, the system of the present invention can be operated with all of the timer modules controlled simultaneously by the control module. Alternatively, the timer modules can be operated in a sequential mode in which each timer module is triggered by the end of the cycle of a preceding module. When it is desired to operate the system in the sequential mode, the sequential start select switch 434 is closed to apply a high input to the SSTSEL line via inverter 436. Gate 402 is disabled so that no MST signal is produced. Referring to FIGS. 3*a* and 3*b*, a high input is applied to OR gate 680 by AND gate 682 when the inputs SEQST and SSTSEL are both high, that is, the switch 434 is closed. OR gate 680 is also connected to receive the MST signal so that when the structure is operating in either the sequential mode, or non-sequentially, flip-flops 684 and 686 are triggered to shift the flip-flop comprising gate 662 and 664 into the initial condition with a high ALLSTOP signal. Upon the completion of its cycle by a given timer module, the output of flip-flop 660 is applied to the SEQSTP line for the next timer module to shift the corresponding flip-flops 684 and 686 in that module.

Counters 610 and 626 are of the type that when a positive signal is applied to the DS line, the output of the counter is displayed and when a negative input is applied, the output of latch 630 is displayed. National display counters MM 74 C 926 are satisfactory. Input DS of counters 610 and 626 are connected to the $\overline{\text{DSH}}$ output which is produced by the switch 500 for controlling whether the stop time and hits or the hold time and hits will be displayed in all timer modules. Gate 502 applies a blanking signal via gate 632 to the displays of each of the timers and thus minimize energy use. 690. When a disqualify signal is received from one or more sensors indicating that a hostage target has been hit, a signal is applied to flip-flop 692 via inverter Flip-flop 692 then produces an output enabling gate 693 which then clocks the 1 Hz train from the control module via gate 633 to the input to the display so that the display is caused to flash. Flip-flop 692 also latches the count at the time the disqualify signal is received into counter 610. An output is also produced as signal $\overline{\text{DSA}}$ which is applied to flip-flop 510 in the control module. Flip-flop 510 then shifts the output of transistor 512 to produce an alarm, for example, a bell or the like, indicating that a hostage target has been hit.

Figure 6:
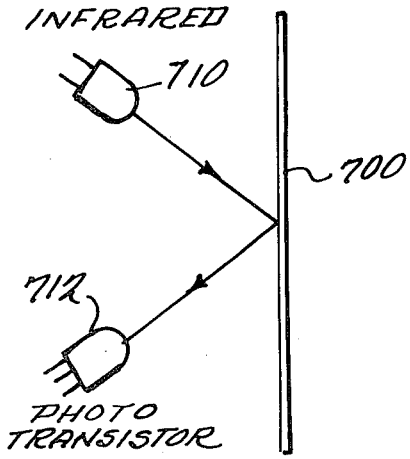
FIG. 6 is a schematic view of the electro-optical sensor.
Figure 5:
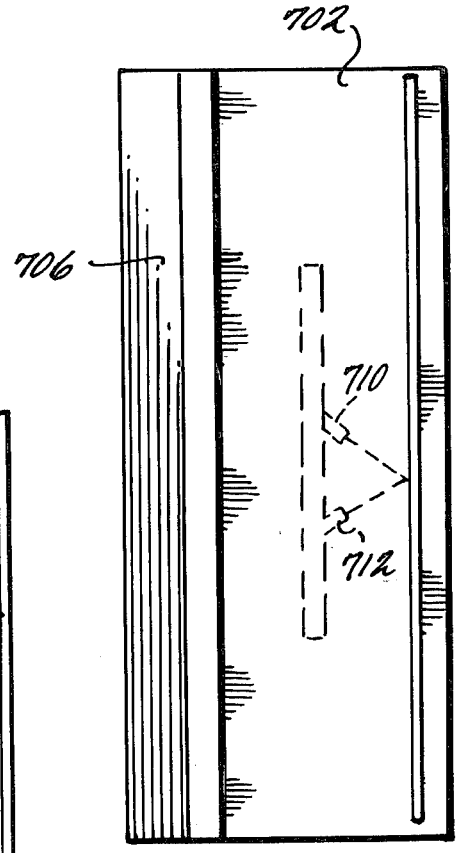
FIG. 5 is a top view of the target with the plate removed.
Figure 4:
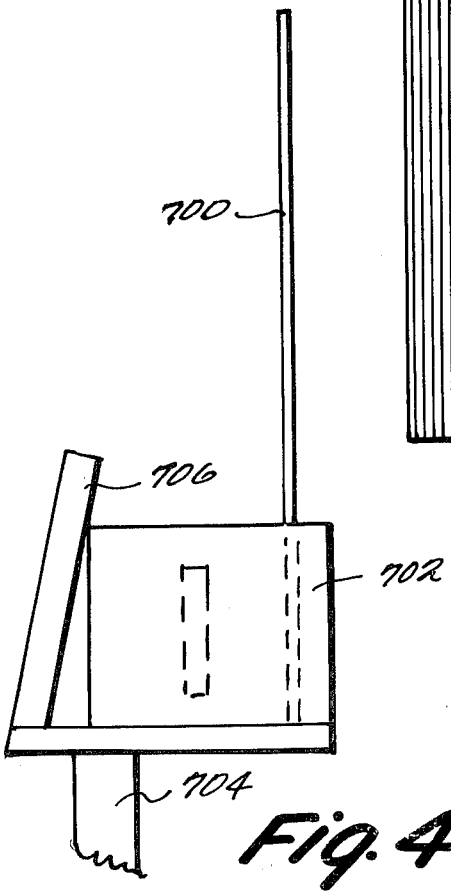
FIG. 4 is a side view of a target.

Reference is now made to FIGS. 4–6 which schematically illustrate one embodiment of a target and sensor which have been found to be particularly satisfactory with the embodiment of the target scoring system shown in detail in FIGS. 1–3. It will be understood that any sensor which provides a signal indicating a hit can be used with the scoring system of the present invention. In the sensor of FIGS. 4–6, light, for example, infrared light, is reflected from a cardboard silhouette removably mounted in a base. The silhouette can be of any shape to realistically depict a target or an innocent hostage or bystander. Alternatively, the target can be made of plywood or any other material. Cardboard targets are particularly practical because they are inexpensive, can take several hits and can be easily replaced. Mannequins can also be used with magnetic transducers to accoustically score hits from real or wax bullets. Sensors can be located in any desired parts of the mannequin, for example, in an arm, leg, head, chest or back, etc. To use the scoring system of the present invention, simulated fire can also be used, for example, bursts of light from a laser mounted within a gun barrel or from a specially designed light-emitting target shooter can be detected to produce hit signals.

Referring to FIGS. 4–6, a thin sheet of cardboard 700 defining a target is mounted in a groove of a base member 702 which may be made of any suitable material, for example, wood. Base member 702 is in turn mounted on a stand 704 to maintain the silhouette at a suitable position and in a vertical orientation. A steel plate 706 is mounted on the stand and overlies member 702 to protect that member and the electro-optical sensor 708 from being destroyed by a projectile. As shown in FIGS. 5 and 6, sensor 708 is comprised of a light-emitting diode 710 and a photo-transistor 712 which are oriented so that light is reflected from the silhouette 700 onto the photo-transistor.

When the silhouette 700 is hit, the silhouette, of course, moves in response to the impact so that photo-transistor 712 produces a pulse at the collector which is coupled via operational amplifier 714 to one input of comparator 720. The change in intensity of light received by the photo-transistor 712 causes the open collector comparator 720 to produce the high signal which is applied to the connected timer module, as described above.

One of the advantages of the above-described embodiment is that any sensor or combination of sensors can be used to produce the hit signals since the system responds to a negative logic OR input.

What is claimed is:

1. A system for scoring hit targets, each including a sensor for producing a hit signal when said target is hit by a projectile from a marksman, comprising:

a control module including means for producing a start signal and, a given time thereafter, a stop signal and means for manually setting said given time; and a plurality of timer modules each connected to said control module and to at least one sensor including first counter means for counting a predetermined number of hit signals between said start and stop signals, second counter means for counting the time, between said start signal and said stop signal, required to count said predetermined number of hit signals, means for manually choosing and setting said predetermined number from a plurality of numbers, and means for displaying the counted number of hits and time.

2. A system as in claim 1, wherein at least one of said targets is a disqualify target having a disqualify sensor for producing a disqualify signal when said target is hit, and wherein said timer module includes means for producing a disqualify indication.

3. A system as in claim 2, wherein said control module includes means for producing a disqualify indication when any of said timer modules produces a disqualify signal.

4. A system as in claim 2, wherein said timer module includes a display.

5. A system as in claim 1, wherein said control module includes means for producing said start signal in response to a sound.

6. A system as in claim 1, wherein said control module includes means for producing said start signal a pseudo-random time after an event.

7. A system as in claim 6, wherein each said timer module includes logic means for producing an ALL-STOP signal comprising said event and indicating counting of said predetermined number of hit signals.

8. A system as in claim 7, wherein said control module includes a counter for counting clock pulses to a presettable number indicating said stop signal, said counter being enabled when at least one of said logic means produces said all stop signal.

9. A system as in claim 8, wherein said control module includes a manual start switch and means for producing said start signal in response to operation of said switch.

10. A system as in claim 9, wherein said control module includes means for producing said start signal in response to a sound and switch means having a first condition in which said start signal can be produced only by said sound and a second condition in which said start signal can be produced only a pseudo-random time after said event.

11. A system as in claim 10, wherein said control module includes a sound switch and means for enabling said sound responsive means only for a predetermined time after operation of said sound switch.

12. A system as in claim 1, wherein each timer module includes a first counter for producing a hold signal upon a first count, a second counter for producing a second signal upon a second count, a display counter connected to a clock for accumulating a count indicating time since said start signal and the number of hit signals, a display latch in said display counter for receiving the count in said display counter when said hold signal is produced and logic means for disabling said display counter from further counting when said second signal is produced.

13. A system as in claim 1, wherein said targets each comprise means defining a silhouette, and means for removably mounting said silhouette, and said sensors each comprise a source of light and means for detecting light reflected from said silhouette.

14. A system as in claim 13, wherein said mounting means includes a base member having a groove for receiving said silhouette defining means and a plate for protecting said light source and detecting means from said projectiles.

15. A system as in claim 1, wherein said control module includes means for producing a sequential start signal for activating one of said timer modules, and wherein each of said timer modules includes means for producing a further sequential signal for activating, following completion of a cycle, another timer module.

16. A system for scoring targets hit by at least one marksman comprising:

a plurality of targets, each including a sensor for producing a hit signal when said target is hit by a projectile from a marksman;

a control module including means for producing a start signal and, a given time thereafter, a stop signal, and means for manually choosing and setting said given time; and a plurality of timer modules each connected to said control module and to at least one sensor including first counter means for counting a predetermined number of hit signals between said start and stop signals, second counter means for counting the time, between said start and stop signal, required to count said predetermined number of hit signals, means for manually setting said predetermined number from a plurality of numbers, and means for displaying the counted number of hits and time.

17. A system for scoring hit targets, each including a sensor for producing a hit signal when said target is hit by a projectile, at least one of said targets producing a disqualify signal when hit by a projectile, comprising:

means for producing a start signal including first means responsive to a sound for producing sid start signal and second means responsive to the counting of a given number for producing said start signal and switch means for enabling said first means and disabling said second means in a first condition and disabling said first means and enabling said second means in a second condition;

means connected to said start signal producing means and adapted for connection to said sensors for counting hit signals produced after said start signal; and means for disabling said counting means and producing an indication when said disqualify signal is produced.

18. A system as in claim 17, further including means for displaying the counted time and counted number of hit signals.

19. A system as in claim 17, including a plurality of said counting means.

20. A target for shooting practice comprising:

means defining a silhouette including a thin sheet of material penetrable by a bullet;

base means for removably mounting said silhouette including a member having a groove for receiving said sheet so that said sheet stands vertically;

an electro-optical sensor mounted on said base member adjacent said groove for detecting a hit on said silhouette including a light source and a detector mounted for producing a first light signal from light reflected from said silhouette when said silhouette is mounted on said base member and a second light signal when said silhouette is hit by a bullet; and a metal plate mounted on said base member and overlying said sensor for protecting said sensor against a hit.

21. A system for scoring hit targets, each including a sensor for producing a hit signal when said target is hit by a projectile, at least one of said targets producing a disqualify signal when hit by a projectile, comprising:

means for producing a start signal;

means connected to said start signal producing means and adapted for connection to said sensors for counting hit signals produced after said start signal;

means for disabling said counting means and producing an indication when said disquality signal is produced;

means for counting the time required to produce a given number of hit signals; and means for disabling said hit signal counting means if said given number is not counted in a predetermined time following said start signal.

22. A system as in claim 21, wherein said start signal producing means includes first means responsive to a sound for producing said start signal and second means responsive to the counting of said given number for producing said start signal and switch means for enabling said first means and disabling said second means in a first condition and for disabling said first means and enabling said second means in a second condition.

23. A system as in claim 22, wherein said second means includes means for producing said start signal after a pseudo-random time delay following counting of a given number.

* * * * *